US009246233B2

(12) United States Patent
Mahon

(10) Patent No.: US 9,246,233 B2
(45) Date of Patent: Jan. 26, 2016

(54) COMPACT LOW SIDELOBE ANTENNA AND FEED NETWORK

(71) Applicant: Optim Microwave, Inc., Camarillo, CA (US)

(72) Inventor: John P. Mahon, Thousand Oaks, CA (US)

(73) Assignee: Optim Microwave, Inc., Camarillo, CA (US)

( * ) Notice: Subject to any disclaimer, the term of this patent is extended or adjusted under 35 U.S.C. 154(b) by 100 days.

(21) Appl. No.: 14/194,395

(22) Filed: Feb. 28, 2014

(65) Prior Publication Data

US 2014/0247191 A1 Sep. 4, 2014

Related U.S. Application Data

(60) Provisional application No. 61/771,622, filed on Mar. 1, 2013.

(51) Int. Cl.
*H01Q 13/00* (2006.01)
*H01Q 19/19* (2006.01)

(52) U.S. Cl.
CPC ..... *H01Q 19/191* (2013.01); *H01Q 19/19* (2013.01)

(58) Field of Classification Search
CPC ... H01Q 19/191; H01Q 19/134; H01Q 19/19; H01Q 19/193
USPC ..... 343/781 P, 781 CA
See application file for complete search history.

(56) References Cited

U.S. PATENT DOCUMENTS 4,788,553 A * 11/1988 Phillips ..... 343/786
5,959,590 A 9/1999 Sanford et al.
6,107,973 A * 8/2000 Knop ..... H01Q 17/001 343/781 CA
6,211,834 B1 4/2001 Durham et al.
6,496,156 B1 * 12/2002 Lusignan ..... H01Q 13/0266 343/781 P
6,522,305 B2 2/2003 Sharman
6,697,028 B1 2/2004 Gothard et al.
6,831,613 B1 12/2004 Gothard et al.
6,982,679 B2 * 1/2006 Kralovec ..... H01Q 13/0208 343/781 CA
7,187,340 B2 * 3/2007 Kralovec ..... H01Q 13/0266 343/781 CA
7,280,081 B2 10/2007 Mahr
7,405,705 B2 * 7/2008 Fukuchi ..... H01Q 1/22 343/702
7,405,708 B2 7/2008 Ahn et al.
7,408,522 B2 8/2008 Ahn et al.
7,907,097 B2 * 3/2011 Syed ..... H01Q 1/24 343/781 CA
8,102,324 B2 * 1/2012 Tuau ..... H01Q 19/193 343/781 CA
2005/0099350 A1 * 5/2005 Gothard et al. ..... 343/781 CA

FOREIGN PATENT DOCUMENTS

WO 87/07771 A1 12/1987

* cited by examiner

*Primary Examiner* — Linh Nguyen
(74) *Attorney, Agent, or Firm* — SoCal IP Law Group LLP; John E. Gunther

(57) ABSTRACT

An antenna may include a primary reflector having a ring focus; a feed body along an axis of the primary reflector, the feed body including a circular waveguide coaxial with the axis of the primary reflector; a sub-reflector disposed facing an end of the circular waveguide; and a generally cylindrical stem extending from a center of the sub-reflector into the circular waveguide to form a section of annular waveguide. A sub-reflector support may mechanically connect a perimeter of the sub-reflector and an outside surface of the feed body. The sub-reflector, the stem, and the feed body may be collectively configured to couple microwave energy between the annular waveguide and the primary reflector.

11 Claims, 6 Drawing Sheets

(c) Optim Microwave 2014

(c) Optim Microwave 2014

(c) Optim Microwave 2014

(c) Optim Microwave 2014

(c) Optim Microwave 2014

(c) Optim Microwave 2014

COMPACT LOW SIDELOBE ANTENNA AND FEED NETWORK

RELATED APPLICATION INFORMATION

This patent claims priority from Provisional Patent Application No. 61/771,622, filed Mar. 1, 2013, entitled COMPACT LOW SIDELOBE ANTENNA AND FEED NETWORK.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to antennas for satellite communications earth stations.

2. Description of the Related Art

Satellite communications systems use one or more orbiting satellite to relay communications between a pair of earth stations. Each earth station typically consists of a transmitter and a receiver coupled to a highly directional antenna. A common form of antenna for transmitting to and receiving from a satellite consists of a parabolic dish reflector and a feed network. Given the large distance between each earth station and the satellite, each earth station must be configured to transmit a relatively high power signal and to receive a very low power signal. To ensure that transmission from a first earth station does not interfere with reception at a second proximate earth station, earth station antennas must be designed to have very low side lobe and back lobe radiation.

Earth station antennas typically have either a center-feed or an offset-feed. In a typical center-feed antenna, the feed network is located along the axis of the parabolic reflector, and thus blocks a portion of the reflector aperture. In an offset-feed antenna, the reflector is an off-axis portion of a parabolic dish and the feed network is located to one side where it does not block a portion of the reflector aperture. Center feeds are commonly used with large diameter reflectors, since the feed network may block only a negligible portion of the reflector aperture. Offset feeds are commonly used with small reflectors where a center feed network would block a substantial portion of the reflector aperture.

Since the feed network of an offset-feed antenna is located to the side of the reflector, an offset-feed antenna occupies a larger volume than a center-feed antenna for equivalent reflector aperture. In some applications, such as portable or mobile earth stations, an antenna may be mounted on a gimbal configured to point the antenna at any desired angle within a hemisphere. In this case, an offset-feed antenna will sweep a substantially larger volume than a center-feed antenna of equivalent aperture, and thus require a substantially larger radome.

In this patent, the term "circular waveguide" means a waveguide segment having a circular cross-sectional shape. Similarly, the term "annular waveguide" means a waveguide segment having a cross-sectional shape of an annulus between two concentric circles. In this patent, the term "port" refers generally to an interface between devices or between a device and free space. A port of a waveguide device may be formed by an aperture in an interfacial surface to allow microwave radiation to enter or exit a waveguide within the device.

Figure 1:
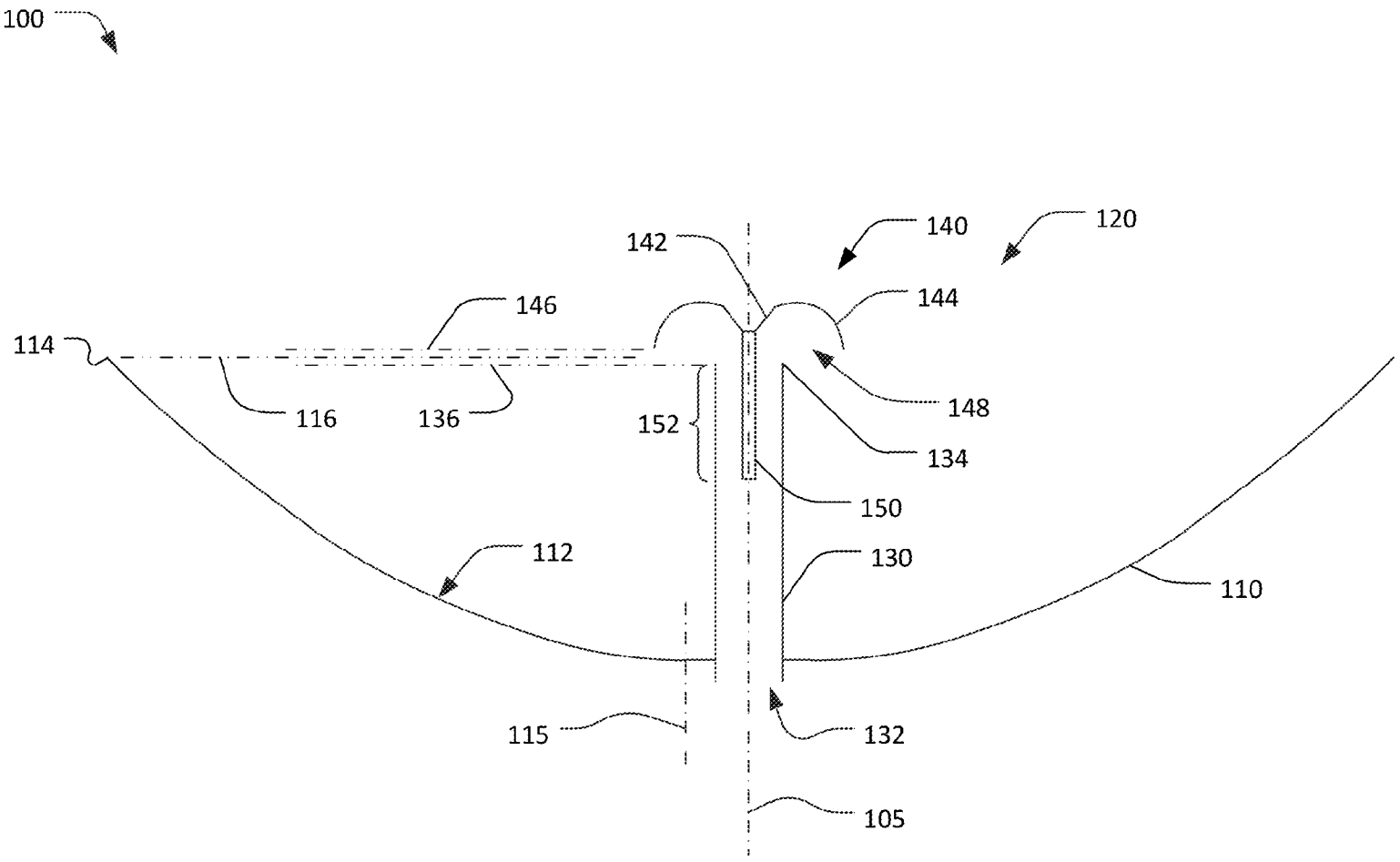
FIG. 1 is a cross-sectional schematic view of a compact low side lobe antenna.

Elements in the drawings are assigned three-digit reference numbers where the most significant digit indicates the figure number where the element was introduced. An element not described in conjunction with a figure may be presumed to be the same as a previously-described element having the same reference number.

DETAILED DESCRIPTION

Description of Apparatus

FIG. 1 is a cross-sectional schematic view of a compact low side lobe antenna 100 which includes a primary reflector 110 and a feed network 120. The primary reflector 110 may be a ring focus reflector having a surface 112 equivalent to a section of a parabola rotated about an antenna axis 105 offset from an axis 115 of the parabola. The focus of the primary reflector 110 will be in the shape of a ring, as contrasted with the point focus of a conventional parabolic reflector. A rim 114 of the primary reflector 110 may lie in a first plane 116.

The feed network 120 may include a circular waveguide 130, a sub-reflector 140, and a stem 150, each of which may be rotationally symmetric about the antenna axis 105. The circular waveguide 130 may have a first end forming a port 132 for introduction of signals to be transmitted from the antenna and for extraction of signals received by the antenna. The port 132 may be coupled, for example, to a diplexer and/or an ortho-mode transducer for separating the transmitted and received signals, neither of which is shown in FIG. 1. The circular waveguide 130 may have a second end 134 that lies in a second plane 136 parallel to the first plane 116.

The subreflector 140 may comprise a generally conical central portion 142, and a curved outer portion 144. The stem 150 may extend from the conical central portion 142 of the sub-reflector 140 into the circular waveguide 130, thus forming a short length of annular waveguide 152. While the element 140 has been termed the "sub-reflector" in consideration of common practice, the sub-reflector 140 is not purely a reflector. Rather, the sub-reflector 140, the stem 150, and the second end 134 of the circular waveguide 130 collectively form a waveguide structure 148 that causes energy propagating in the annular waveguide 152 to bend radially outward through an angle approaching 180 degrees and thus be directed towards the primary reflector 110. The curved outer portion 144 of the sub-reflector 140 may have a rim that lies in a third plane 146 parallel to the first plane 116 and the second plane 136.

The "generally conical" center portion 142 of the sub-reflector 140 may be a surface generated by rotating a line passing through a fixed vertex. The "generally conical" center portion 142 of the sub-reflector 140 may be generated by rotating a straight line to form a right circular cone. The "generally conical" center portion 142 of the sub-reflector 140 may be generated by rotating a curved line, in which case the center portion 142 will deviate from a true cone.

In the example of FIG. 1, the first plane 116, the second plane, 136, and the third plane 146 may be, but are not necessarily, coplanar or nearly coplanar. In this context, two planes are "nearly coplanar" if the distance between these planes may be small compared to the wavelength at the frequency of operation of the antenna 100.

Figure 2:
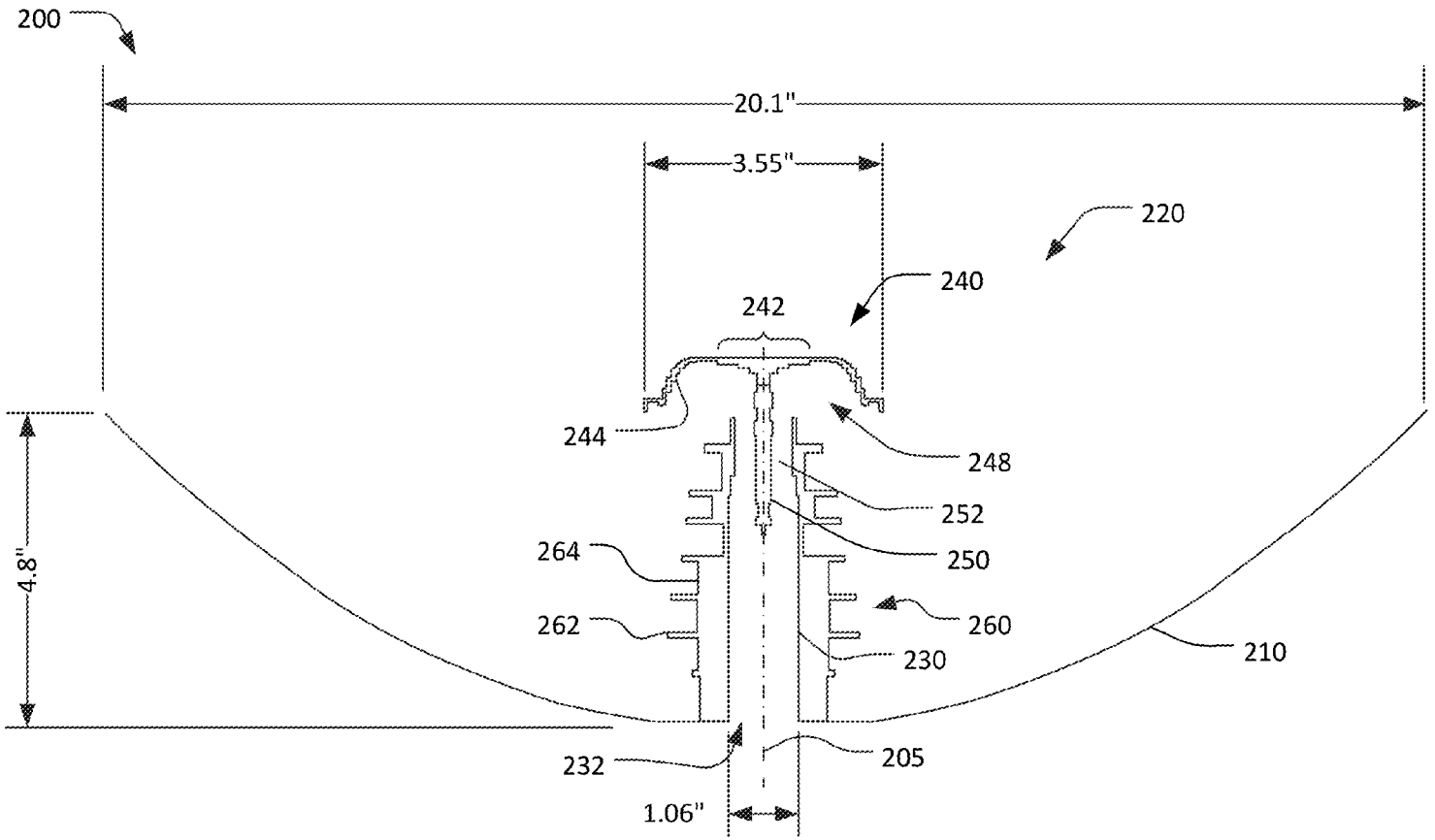
FIG. 2 is a cross-sectional view of another compact low side lobe antenna.

Referring now to FIG. 2, a compact low side lobe antenna 200 may include a primary reflector 210 and a feed network 220. The primary reflector 210 may be a ring focus reflector, as previously described.

The feed network 220 may include a feed body 260 enclosing a circular waveguide 230, a sub-reflector 240, and a stem 250. The primary reflector 210, the feed body 260, the sub-reflector 240, and the stem 250 may all be rotationally symmetric about an antenna axis 205 (also the axis of the circular waveguide 230). Although section lines are not shown in FIG. 2, it should be understood that the feed body 260, the sub-reflector 240, and the stem 250 are solid objects shown in cross-section.

The circular waveguide 230 may have a first end forming a port 232 for introduction of signals to be transmitted from the antenna and for extraction of signals received by the antenna. The sub-reflector 240 may comprise a generally conical central portion 242, and a curved outer portion 244. The stem 250 may extend from the conical central portion 242 of the sub-reflector 240 into the circular waveguide 230, thus forming a short length of annular waveguide 252.

Figure 3:
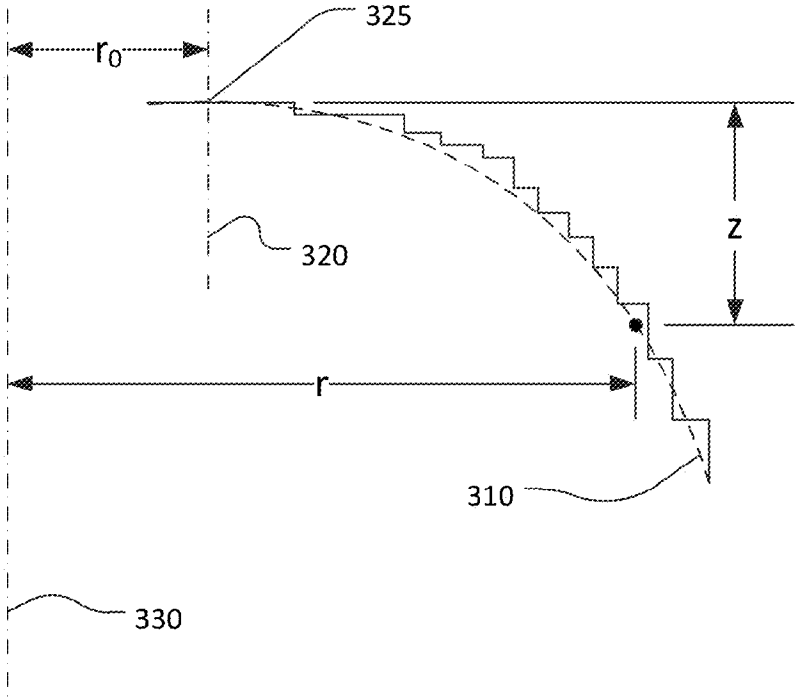
FIG. 3 is a side view of a surface of a warped parabolic surface.

The curved outer portion 244 of the sub-reflector 240 may have the shape of a warped ring-focus parabola. As shown in FIG. 3, the curved outer portion 244 may be generated by rotating a warped parabolic curve 310 about an antenna axis 330. The warped parabolic curve 310 may have a vertex 325 located along a local axis 320 which is displaced from the antenna axis by a distance $r_0$. The warped parabolic curve 310 may be defined by the equation:

$$4F(z+\alpha z^2)=(r-r_0)^2+\beta(r-r_0)^4 \quad (1)$$

wherein

F=the "focal length" of the parabolic curve, z=distance along the antenna axis measured from the vertex of the parabolic curve, r=radial distance from the antenna axis, r0=radial distance from the antenna axis to the local axis of the warped parabolic curve, and $\alpha$ and $\beta$=warping coefficients.

When $\alpha=\beta=0$, the curve 310 is a parabola. Note that the "focal length" F does not have a physical meaning unless the curve 310 is one of the true conic sections (i.e. a parabola, an ellipse, or a hyperbola).

Returning now to FIG. 2, the sub-reflector 240, the stem 250, and the feed body 260 may collectively form a waveguide structure 248 that causes energy propagating in the annular waveguide 252 to bend radially outward through an angle approaching 180 degrees and thus be directed towards the primary reflector 110. An outside diameter of the stem 250 and an inside diameter of the circular waveguide 230 may change in steps to provide impedance matching from the circular waveguide 230 through the annular waveguide section 252 to the waveguide structure 248.

The sub-reflector 240 may be formed with continuously curved surfaces, as shown in FIG. 1, or may have surfaces formed as a series of steps, as shown in FIG. 2. Forming inner and outer surfaces of the sub-reflector 240 as a series of steps may simplify machining, measuring, and modeling the sub-reflector surfaces. When the sub-reflector has surfaces formed as series of steps, the height of each step may be small relative to the wavelength at the frequency of operation of the antenna 200.

An outer surface of the feed body 260 may be corrugated, which is to say the outer surface of the feed body 260 may include ribs 262 having relatively larger diameters separated by regions 264 having relatively smaller diameter. The ribs may be configured to concentrate energy radiated from the waveguide structure 248 close to the feed body 260. The ribs closest to the subreflector 240 also help control the match of the input waveguide, and antenna pattern properties such as cross polarization and side lobes.

The feed body 260, the sub-reflector 240, and the stem 250 may be formed of a conductive metal material such as aluminum or copper. In this case, the feed body 260, the sub-reflector 240, and the stem 250 may be fabricated by machining operations such as turning on a lathe or milling on a milling machine. The feed body 260, the sub-reflector 240, and/or the stem 250 may be fabricated by casting or some other metal working process. The sub-reflector 240 and the stem 250 may be fabricated as a single piece. The sub-reflector 240 and the stem 250 may be fabricated as two pieces assembled by, for example, soldering, brazing, bonding, or mating a threaded portion of the stem with a threaded hole in the sub-reflector.

The feed body 260, the sub-reflector 240, and/or the stem 250 may be formed of a nonconductive material, such as a ceramic or plastic material, coated with a conductive coating. For example, the feed body 260, the sub-reflector 240, and/or the stem 250 may be formed by casting, injection molding, or machining a plastic material. Subsequently, the plastic component may be coated with a conductive layer such as gold or aluminum by plating, sputtering, evaporation, or some other process.

FIG. 2 provides exemplary dimensions of an embodiment of the antenna 200 for use in communicating with an X-band communications satellite, where a frequency band from 7.25 GHz to 7.75 GHz may be used for a downlink from a satellite and a frequency band from 7.90 GHz to 8.40 GHz may be used for an uplink to the satellite. Specifically, a diameter of the primary reflector 110 may be 20.1 inches, a depth of the primary reflector 110 may be 4.8 inches, an outside diameter of the sub-reflector 240 may be 3.55 inches, and a diameter of the circular waveguide 230 at the port 232 may be 1.06 inches. All dimensions are nominal and subject to normal manufacturing tolerances. For reference, the free-space wavelengths for the operating frequency band of the antenna 200 range from 1.41 inches to 1.63 inches and the outside diameter of the sub-reflector may be about 2.3 wavelengths at the center of the operating frequency range of the antenna. The outside diameter of the sub-reflector may be, for example, 2 to 4 wavelengths at the center of the operating frequency range of the antenna.

Figure 4:
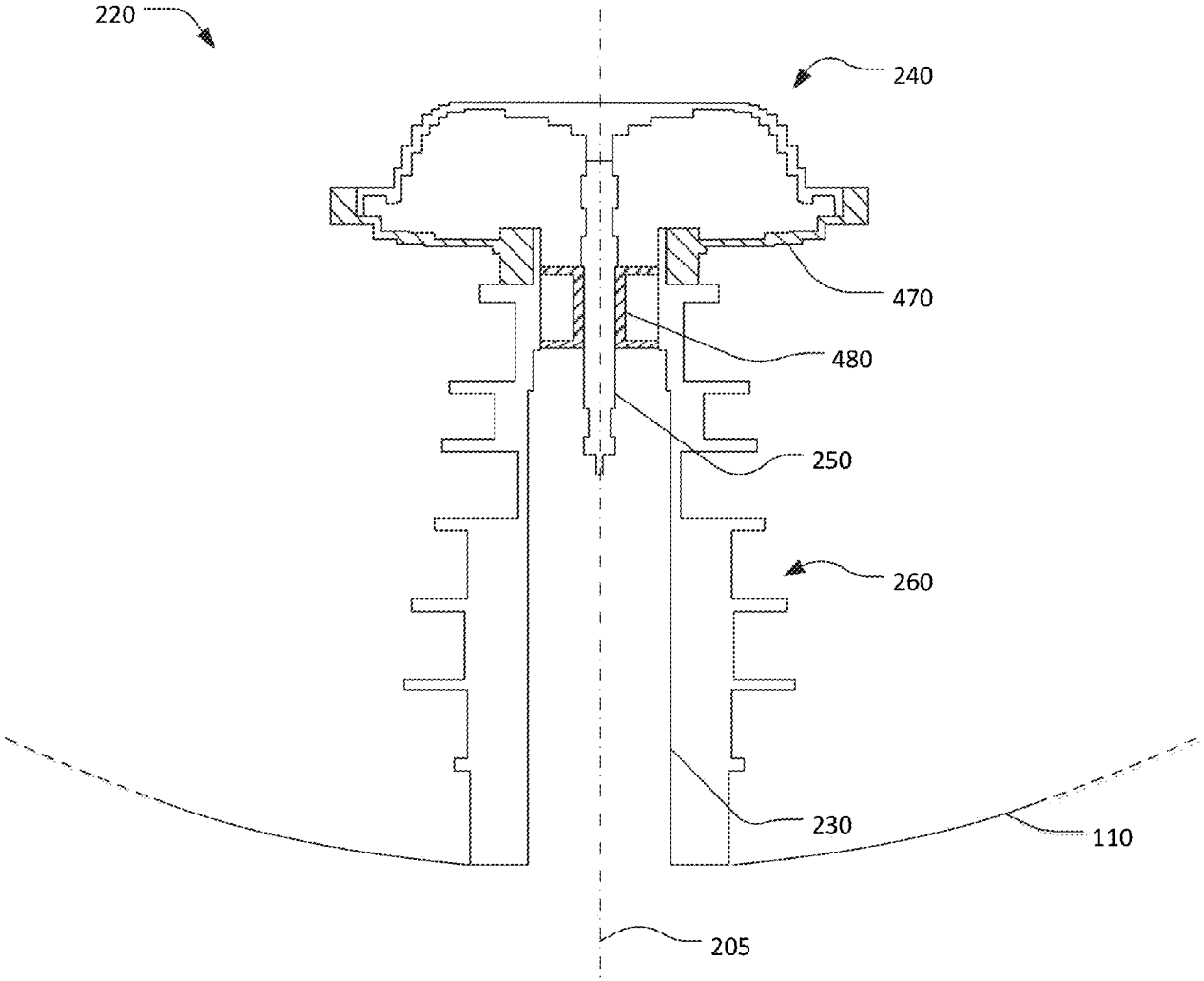
FIG. 4 is a cross-sectional view of the feed network of the antenna of FIG. 2.

FIG. 4 provides an enlarged cross-sectional view of the feed network 220 including the feed body 260, the circular waveguide 230, the sub-reflector 240, the stem 250, and a portion of the primary reflector 110. All of these elements are rotationally symmetrical about the antenna axis 205. Although section lines are not shown, the feed body 260, the sub-reflector 240 and the stem 250 are solid objects shown in cross-section. Also shown in FIG. 4 are a sub-reflector support 470 and a stem support 480 (also shown in cross-section) that were not previously shown in FIG. 2.

The sub-reflector support 470 may be configured to mechanically support the sub-reflector 240 in a desired position relative to the food body 260. The sub-reflector support 470 may also provide a seal between the sub-reflector 240 and the feed body 260 to prevent moisture, dirt, and other environmental contaminants from entering the circular waveguide 230. The sub-reflector support 470 may be formed with continuously curved surfaces or, as shown in FIG. 4, may have surfaces formed as a series of steps. Forming the inner and outer surfaces of the sub-reflector support 470 as a series of steps may simplify machining, measuring, and modeling the sub-reflector support. The sub-reflector support 470 may be fabricated from a dimensionally stable, low-loss dielectric material suitable for use in an outdoor environment. The sub-reflector support 470 may be fabricated, for example, from a glass-filled polyphenylene sulfide (PPS) plastic material, such as RYTON® R4 available from Chevron Philips Chemical Co., which has a coefficient of thermal expansion similar to that of aluminum. The sub-reflector support 470 may be fabricated from another low-loss dielectric material.

The sub-reflector support 470 may be configured to press-fit over the feed body 260 and the sub-reflector 240. The sub-reflector support 470 may be bonded to one or both of the feed body 260 and the sub-reflector 240 using a suitable adhesive.

The stem support 480 may be configured to mechanically support the stem 250 centered within the circular waveguide 230. The stem support 480 may be shaped as a bobbin with two flanges, as shown in FIG. 4. The stem support may have some other shape, such as a cylinder with a single flange or a single disc, configured to center the stem 250 within the circular waveguide 230. The stem support 480 may be fabricated from a machinable, dimensionally stable, low-loss plastic or other dielectric material. The stem support 480 may be fabricated, for example, from a cross-linked polystyrene plastic material, such as REXOLITE® 1422 available from C-LEC Plastics.

The stem support 480 may be configured to press-fit over the stem 250 and slip-fit within the circular waveguide 230. The stem support 480 may be bonded to one or both of the stem 250 and the interior of the feed body 260 using a suitable adhesive.

Figure 5:
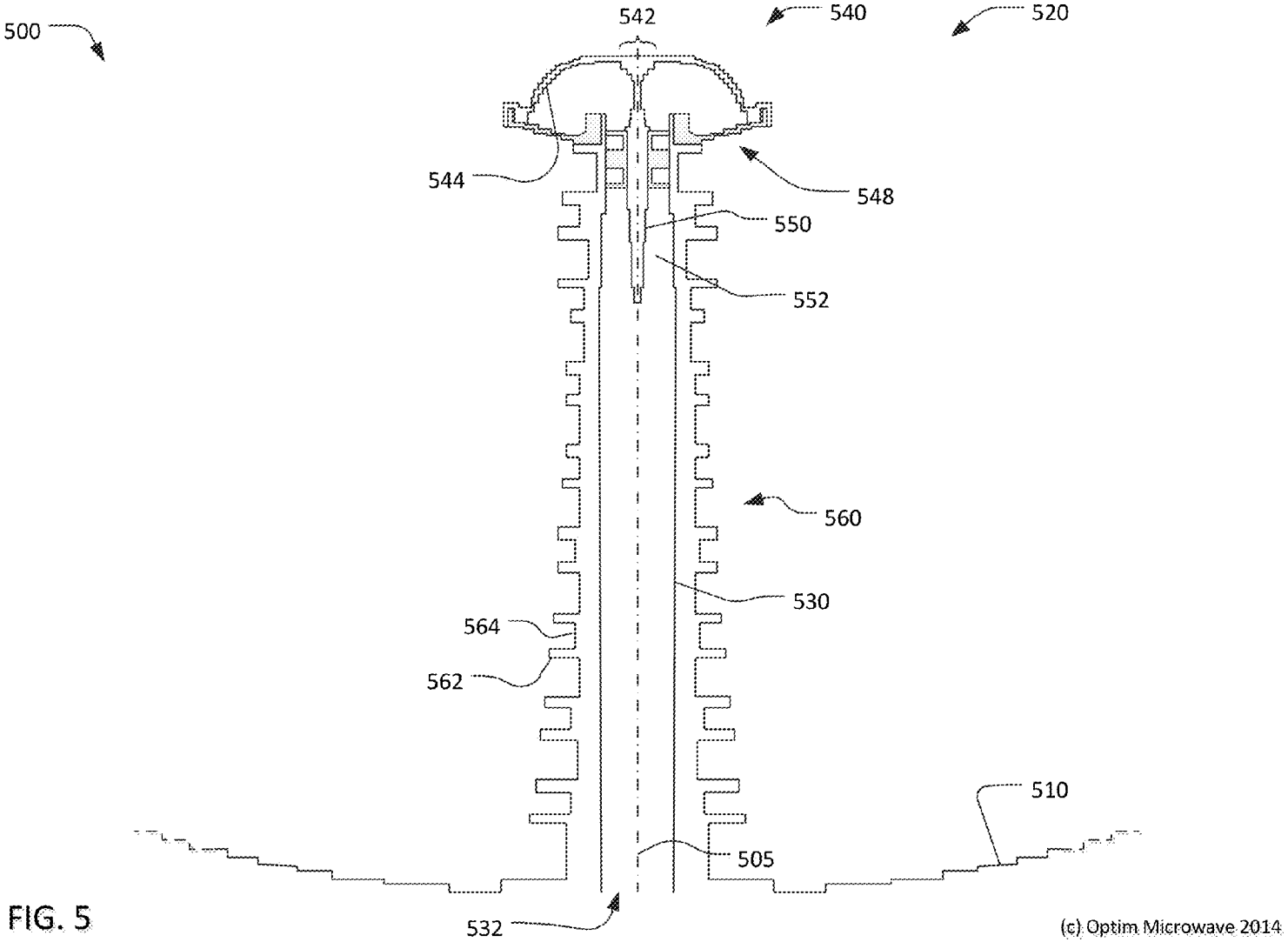
FIG. 5 is a cross-sectional view of another compact low side lobe antenna.

Referring now to FIG. 5, another compact low side lobe antenna 500 may include a primary reflector 510, only a portion of which is shown, and a feed network 520. The primary reflector 510 may be a ring focus reflector, as previously described.

The feed network 520 may include a feed body 560 enclosing a circular waveguide 530, a sub-reflector 540, and a stem 550. The primary reflector 510, the feed body 560, the sub-reflector 540, and the stem 550 may all be rotationally symmetric about an antenna axis 505 (also the axis of the circular waveguide 530). Although section lines are not shown in FIG. 5, it should be understood that the feed body 560, the sub-reflector 540, and the stem 550 are solid objects shown in cross-section.

The primary reflector 510 may have a substantially larger diameter that the diameter of the primary reflector 210 of the antenna 200. The larger diameter of the primary reflector 510 may necessitate a correspondingly longer feed body 560.

The circular waveguide 530 may have a first end forming a port 532 for introduction of signals to be transmitted from the antenna and for extraction of signals received by the antenna. The sub-reflector 540 may comprise a generally conical central portion 542, and a curved outer portion 544. The curved outer portion 544 may have the shape of a warped ring-focus parabola as previously described. The stem 550 may extend from the conical central portion 542 of the sub-reflector 540 into the circular waveguide 530, thus forming a short length of annular waveguide 552. The sub-reflector 540 may be formed with continuous or stepped surfaces as previously described.

The sub-reflector 540, the stem 550, and the feed body 560 may collectively form a waveguide structure 548 that causes energy propagating in the annular waveguide 552 to bend radially outward through an angle approaching 180 degrees and thus be directed towards the primary reflector 510.

An outer surface of the feed body 560 may be corrugated, which is to say the outer surface of the feed body 560 may include ribs 562 having relatively larger diameters separated by regions 564 having relatively smaller diameter. The corrugations may be configured to concentrate energy radiated from the waveguide structure 548 close to the feed body 560.

The feed body 560, the sub-reflector 540, and the stem 550 may be formed of a conductive metal material such as aluminum or copper, and may be fabricated by machining, casting, or some other metal working process as previously described. The feed body 560, the sub-reflector 540, and/or the stem 550 may be formed of a nonconductive material, such as a ceramic or plastic material, coated with a conductive coating, as previously described.

Figure 6:
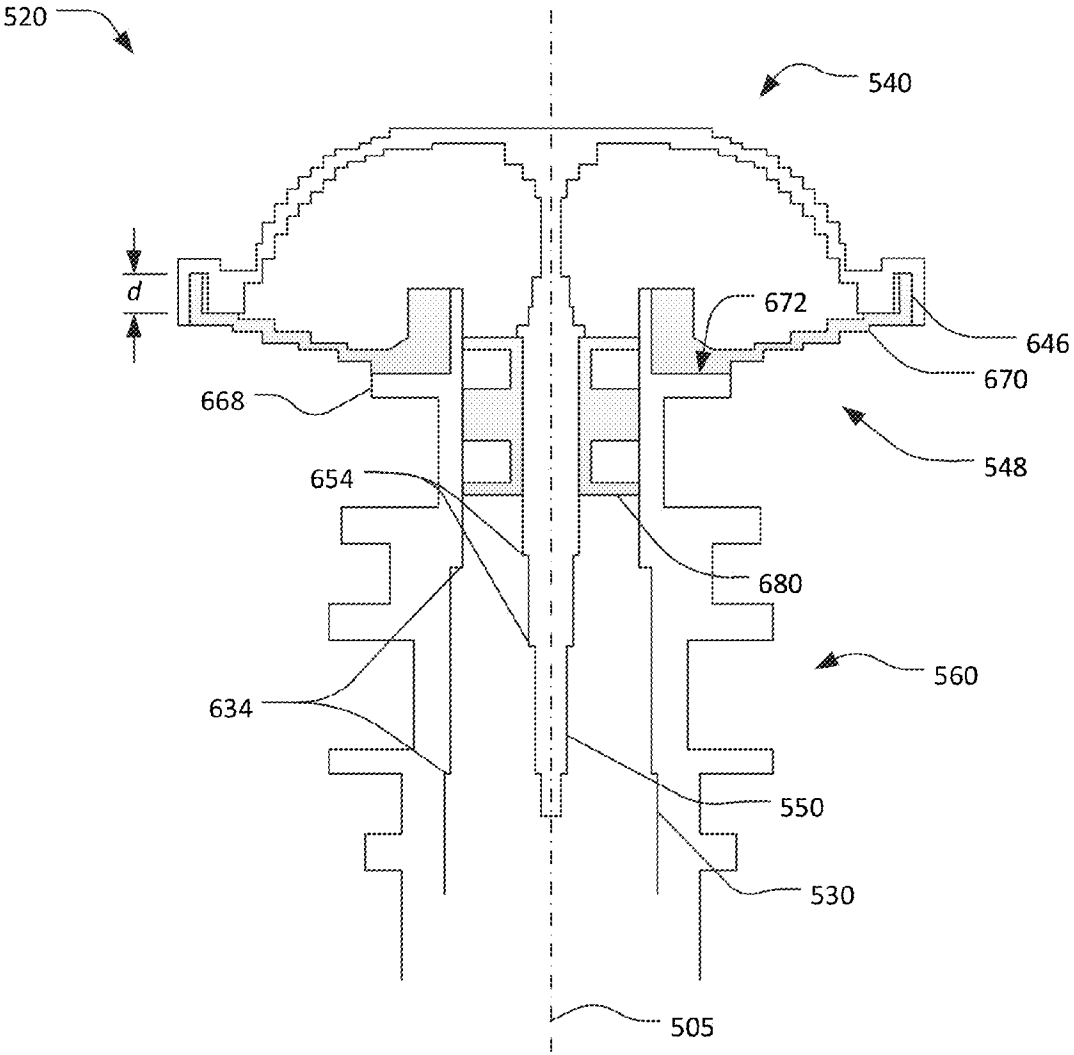
FIG. 6 is a cross-sectional view of a portion of the feed network of the antenna of FIG. 5.

FIG. 6 provides an enlarged cross-sectional view of a portion of the feed network 520 including the feed body 560, the circular waveguide 530, the sub-reflector 540, and the stem 550. Although section lines are not shown, the feed body 560, the sub-reflector 540 and the stem 550 are solid objects shown in cross-section. All of these elements are rotationally symmetrical about the antenna axis 505. Also shown in FIG. 6 are steps 634 and 654, a choke groove 646, a sub-reflector support 670 and a stem support 680 that were previously shown, but not identified, in FIG. 5.

The choke groove 646 may be disposed around a perimeter of the subreflector 540. The presence of the choke groove 646 may help control antenna pattern properties such as side lobes.

An outside diameter of the stem 550 may change in steps 654, and an inside diameter of the circular waveguide 530 may change in steps 634 to provide impedance matching from the circular waveguide 530 through the annular waveguide section to the waveguide structure 548.

The sub-reflector support 670 may be configured to mechanically support the sub-reflector 540 in a desired position relative to the food body 560. The sub-reflector support may mechanically connect the perimeter of the sub-reflector 540 with the outside of the feed body 560. The sub-reflector support 670 may be formed with continuously curved surfaces or, as shown in FIG. 6, may have surfaces formed as a series of steps. Forming the inner and outer surfaces of the sub-reflector support 670 as a series of steps may simplify machining, measuring, and modeling the sub-reflector support. The sub-reflector support 670 may be fabricated from a dimensionally stable, low-loss dielectric material suitable for use in an outdoor environment. The sub-reflector support 670 may be fabricated, for example, from a glass-filled polyphenylene sulfide (PPS) plastic material, such as RYTON® R4 available from Chevron Philips Chemical Co., which has a coefficient of thermal expansion similar to that of aluminum. The sub-reflector support 670 may be fabricated from another dielectric material.

The sub-reflector support 670 may be configured to press-fit over the feed body 560 and the sub-reflector 540. The sub-reflector support 670 may be configured to engage the choke groove 646 around the perimeter of the sub-reflector 540. The sub-reflector support 670 may be bonded to one or both of the feed body 560 and the sub-reflector 540 using a suitable adhesive. A surface 672 of the sub-reflector support 670 may be adjacent to, and mechanically supported by, a top rib 668 of the feed body 560. Mechanically supporting the surface 672 of the sub-reflector support 670 may increase the physical robustness of the feed network 520. The feed network 520 may be suitable for use in portable applications where an antenna may encounter substantial shock and vibration during transportation and handling.

The sub-reflector support 670 may also provide a seal between the sub-reflector 540 and the feed body 560 to prevent moisture, dirt, and other environmental contaminants from entering the circular waveguide 530.

The stem support 680 may be configured to mechanically support the stem 550 centered within the circular waveguide 530. The stem support 680 may be shaped, for example, as a bobbin with three flanges, as shown in FIG. 6, or a bobbin with two flanges as shown in FIG. 3. The stem support 680 may have some other shape, such as a cylinder with a single flange or a single disc, configured to center the stem 550 within the circular waveguide 530. The stem support 680 may be fabricated from a machinable, dimensionally stable, low-loss plastic or other dielectric material. The stem support 480 may be fabricated, for example, from a cross-linked polystyrene plastic material, such as REXOLITE® 1422 available from C-LEC Plastics.

The stem support 680 may be configured to press-fit over the stem 550 and slip-fit within the circular waveguide 530. The stem support 680 may be bonded to one or both of the stem 550 and the interior of the feed body 560 using a suitable adhesive.

An antenna, such as the antennas 100, 200, and 500, may be designed using a commercial software package such as CST Microwave Studio. An initial model of the antenna may be generated with estimated dimensions for the primary reflector and the feed network. The initial model may then be analyzed, and parameters such as the reflection coefficient at the antenna input port, antenna gain, and side lobe and back lobe radiation may be determined. The parameters and dimensions of the model may then be iterated manually or automatically to minimize the reflection coefficient, side lobe energy and back lobe radiation across an operating frequency band. Parameters that may be automatically optimized may include, for example, the warping coefficients $\alpha$, $\beta$, that determine the shape of the curved outer portion of the sub-reflector and the shape of the generally conical center portion of the sub-reflector. As previously described, FIG. 2 provides some dimensions for an embodiment of the antenna for use in the frequency range of 7.75 to 8.40 GHz. These dimensions may be scaled (inversely with frequency) to provide an initial model for operation in other different frequency bands.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. An antenna comprising:

a primary reflector having a ring focus;

a feed body along an axis of the primary reflector, the feed body including a circular waveguide coaxial with the axis of the primary reflector;

a sub-reflector disposed facing an end of the circular waveguide;

a generally cylindrical stem extending from a center of the sub-reflector into the circular waveguide to form a section of annular waveguide; and a sub-reflector support that mechanically connects a perimeter of the sub-reflector and an outside surface of the feed body, wherein the sub-reflector, the stem, and the feed body are collectively configured to couple microwave energy between the annular waveguide and the primary reflector.

2. The antenna of claim 1, wherein the sub-reflector comprises:

a generally conical center portion; and a curved outer portion.

3. The antenna of claim 2, comprising a choke groove around a perimeter of the sub-reflector.

4. The antenna of claim 2, wherein the curved outer portion has a warped parabolic shape.

5. The antenna of claim 2, wherein the curved outer portion is defined by the equation:

$$4F(z+\alpha z^2)=(r--r_0)^2+\beta(r-r_0)^4 \quad (1)$$

wherein

F=a focal length of the warped parabolic shape, z=a distance along the antenna axis measured from the vertex of the parabolic curve, r=a radial distance from the antenna axis, $r_0$=a radial distance from the axis of the primary reflector to a local axis of the warped parabolic shape, and $\alpha$ and $\beta$=warping coefficients.

6. The antenna of claim 1, further comprising a dielectric stem support to support the stem centered within the circular waveguide.

7. The antenna of claim 1, further comprising a plurality of ribs extending radially outward from the feed body.

8. The antenna of claim 7, wherein the plurality of ribs includes an upper rib closest to the sub-reflector, and a portion of the sub-reflector support is adjacent to and supported by the upper rib.

9. The antenna of claim 1, wherein the sub-reflector support is configured to create a seal between the sub-reflector and the feed body.

10. The antenna of claim 1, wherein the feed body and the sub-reflector are fabricated from aluminum or an aluminum alloy, and the sub-reflector support is fabricated from a low-loss dielectric material having a thermal expansion coefficient similar to that of aluminum.

11. The antenna of claim 10, wherein the sub-reflector support is fabricated from a glass-filled polyphenylene sulfide plastic material.

* * * * *